US007886660B1

(12) United States Patent
Sherwood et al.

(10) Patent No.: US 7,886,660 B1
(45) Date of Patent: Feb. 15, 2011

(54) SYSTEM AND TRASH RECEPTACLE FOR COLLECTING AND COMPACTING TRASH

(76) Inventors: Christopher R. Sherwood, 1350 Main St., #908, Sarasota, FL (US) 34236; Dale Walker, 549 Belted King Fisher Dr. North, Palm Harbor, FL (US) 34683

( * ) Notice: Subject to any disclaimer, the term of this patent is extended or adjusted under 35 U.S.C. 154(b) by 206 days.

(21) Appl. No.: 12/264,102

(22) Filed: Nov. 3, 2008

(51) Int. Cl.
*B30B 15/06* (2006.01)

(52) U.S. Cl. ..... 100/229 A; 100/100; 100/215; 100/219; 100/233; 100/245; 100/255

(58) Field of Classification Search ..... 100/100, 100/215, 229 R, 229 A, 233, 245, 255, 269.01, 100/219, 295; 220/315, 331
See application file for complete search history.

(56) References Cited

U.S. PATENT DOCUMENTS

| | | | | | |
|---|---|---|---|---|---|
| 3,039,383 | A | * | 6/1962 | Windle et al. | 100/240 |
| 3,625,140 | A | * | 12/1971 | Glanz | 100/100 |
| 3,691,967 | A | | 9/1972 | Mettetal, Jr. | |
| 3,955,492 | A | | 5/1976 | Topolay | |
| 3,961,573 | A | * | 6/1976 | Schmidt | 100/100 |
| 4,152,979 | A | | 5/1979 | Schmidt | |
| 4,257,322 | A | * | 3/1981 | McDermott | 100/229 A |
| 4,290,352 | A | | 9/1981 | Schmidt et al. | |
| 4,442,766 | A | * | 4/1984 | Hawkins | 100/35 |
| 4,878,596 | A | * | 11/1989 | Cawley et al. | 220/812 |
| 5,118,000 | A | * | 6/1992 | Howell et al. | 220/315 |
| 5,203,669 | A | * | 4/1993 | Klossek et al. | 414/525.2 |
| 5,465,914 | A | | 11/1995 | Faccia | |
| 5,575,201 | A | | 11/1996 | Fenner et al. | |
| 5,842,652 | A | | 12/1998 | Warsing et al. | |
| 5,927,626 | A | | 7/1999 | Shinjo et al. | |
| 6,158,336 | A | | 12/2000 | Cambiano | |
| 6,247,662 | B1 | | 6/2001 | Hamilton | |
| 6,505,550 | B2 | | 1/2003 | Hamilton | |
| 6,543,343 | B2 | | 4/2003 | Taylor | |
| 6,739,535 | B2 | | 5/2004 | LaBarbera | |
| 6,983,902 | B2 | | 1/2006 | Faccia | |
| 7,100,500 | B2 | | 9/2006 | Soler | |
| 7,434,507 | B1 | | 10/2008 | Sherwood | |
| 2004/0031403 | A1 | | 2/2004 | Johnson | |
| 2007/0101875 | A1 | | 5/2007 | Poss et al. | |

* cited by examiner

*Primary Examiner*—Jimmy T Nguyen
(74) *Attorney, Agent, or Firm*—Allen, Dyer, Doppelt, Milbrath & Gilchrist, P.A.

(57) ABSTRACT

A trash receptacle compaction system for compacting trash, a trash receptacle of the system having upstanding front, side and back panels, a closed bottom, and a lid. The system further includes a drivable satellite vehicle having a power unit which is operably connectable between the front panel and a compaction ram of the trash receptacle. The separate compaction ram is positioned within the receptacle for slidable movement between the forwardly front panel and the rearwardly rear panel, the compaction ram being driven by the power unit to compact the trash within the receptacle after the satellite vehicle is driven to and properly aligned with the trash receptacle. These trash compaction cycles minimize the frequency of trash receptacle emptying required.

9 Claims, 14 Drawing Sheets

SYSTEM AND TRASH RECEPTACLE FOR COLLECTING AND COMPACTING TRASH

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This disclosure relates generally to vehicles and systems for collecting and removing trash in commercial and residential community settings and more particularly to a system and trash receptacle for intermittently compacting trash deposited within the trash receptacle to reduce the frequency of trash receptacle emptying required.

2. Description of Related Art

In commercial and residential community settings, large receptacles or bins are provided at strategic locations for individual depositing of trash into one or more trash receptacles. One or more lids are typically pivotally openable for trash to be deposited into the receptacle and periodically, a large waste collection vehicle is scheduled to visit each of the trash receptacles and by interengagement with large forwardly extending forks, temporary engagement with each trash receptacle to lift it and invert it over the open top of the truck cargo bed of the vehicle to empty trash from the trash receptacle and then to replace it on the ground for continued use.

The trash collection service for this routine scheduled emptying of the trash receptacles constitutes a significant expenditure for the commercial establishment or residential community and is typically billed on a per-visit basis. However, many times these trash receptacles are less than full and the emptying schedule is excessive in that the trash receptacles could easily be filled with additional trash before emptying occurs.

Moreover, trash which is typically loosely thrown into these trash receptacles accelerates the appearance of trash receptacle fullness whereas, if somehow compacted or otherwise reduced in overall volume, the trash receptacle could easily handle significantly increased amounts of compacted trash before the receptacle would be required to be emptied.

A number of prior art vehicles, systems and receptacles are known in prior art which attempt to address this issue of increasing the efficiency and cost of trash removal as follows:

U.S. Pat. No. 3,691,967 to Mettetal, Jr. discloses a mobile apparatus for compacting refused. It is the primary object of the '967 patent to provide a mobile refuse compacting vehicle for compacting refused contained in separately located receptacles which will extend the time interval between the unloading of such receptacles. LaBarbera teaches a mobile trash pulverizer in U.S. Pat. No. 6,739,535. As is shown in FIG. 1, the self-propelled vehicle pulls up to an open top container and, using a pivoting arm with a heavy pulverizing roller, compacts the trash contained therein.

A device for compacting waste in containers is disclosed in newly-issued U.S. Pat. No. 7,100,500 to Soler as shown in FIG. 3. The Soler device teaches a vehicle having a platform, handling arm, compactor roller and support frame. A transportable recyclable materials densifier is disclosed in U.S. Pat. No. 6,543,343 to Taylor. The system of the '343 patent uses an integral conveyor, separator and compacting chamber.

Shinjo, et al. teach a solid substance crushing vehicle which is able to move to a collection center in U.S. Pat. No. 5,927,626 and a waste recycling processing vehicle is described in U.S. Pat. No. 5,842,652 to Warsing, et al.

A compactor comprising a rotating auger for breaking waste material is disclosed in U.S. Pat. No. 5,575,201 to Fenner, et al. and Faccia teaches a combined shredding and mixing truck in U.S. Pat. Nos. 5,465,914 and 6,983,902.

Waste compaction apparatus with a screw conveyor for waste material compacting is taught by Hamilton in U.S. Pat. No. 6,247,662 and the method and apparatus is disclosed in U.S. Pat. No. 6,505,550. The front page of a refuse collecting and disposal handling vehicle teaching two vehicles working in tandem is taught by Talamantez in U.S. Pat. No. 6,305,625.

My previous U.S. Pat. No. 7,434,507 teaches a unique system and trash receptacle as a separate service offering for compacting trash deposited within the trash receptacle periodically in between times of trash removal by a commercial trash collection operation. A compaction vehicle periodically visits each trash receptacle in the system to operate a power unit which effects compaction of the trash collected within the trash receptacle and, at a point when the operator of the compaction vehicle determines that the compacted trash has adequately filled the receptacle, a radio signal is activated to advise the waste collection company that the trash receptacle is ready for emptying.

The present disclosure teaches an improved system and trash receptacle for periodically compacting trash deposited into the receptacle in between times of trash removal from the receptacle by a commercial trash collection operation. An improved compaction vehicle periodically visits each trash receptacle in the system and, after proper engagement with the internal moveable compaction ram, a power unit attached to the front of the vehicle will actuate the compaction ram to effect compaction of the trash then collected within the receptacle. Trash compaction by this new system more efficiently effects trash compaction for extended time periods between each trash receptacle emptying.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This disclosure is directed to a system for compacting trash within a trash receptacle including a trash receptacle having upstanding front, side and back panels, a closed bottom, and a lid. A compaction ram sized in width and length similar to that of the front panel and positioned within the receptacle against the front panel and is separate and movably held by spaced parallel upper and lower slide rails. A drivable satellite vehicle having power unit temporarily connectable to the compaction ram drives the compaction ram into the interior volume of the trash receptacle which compacts the trash within the receptacle at the time to minimize the frequency of receptacle emptyings required.

It is therefore an object of this disclosure to provide a system for compacting trash within a trash receptacle of the system at least once in between scheduled periods of entirely emptying of the trash receptacle.

Yet another object of this invention is to provide a means for compacting loose trash deposited within a uniquely configured trash receptacle to reduce the cost and frequency of emptying of the trash receptacle by use of a commercial trash collection vehicle.

Yet another object of this invention is to provide a trash receptacle which is adapted for compacting loose trash deposited therewithin by a compaction vehicle equipped with a power unit for temporary engagement with a movable compaction ram within the trash receptacle to effect compaction of the loose trash collected within the trash receptacle.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference of the drawings and by study of the following descriptions.

BRIEF DESCRIPTION OF THE SEVERAL VIEWS OF THE DRAWING(S)

FIGS. 6 (C, D and E) are side elevation section views similar to FIG. 6B showing the progression of the compaction ram within the trash receptacle.

Figure 1:
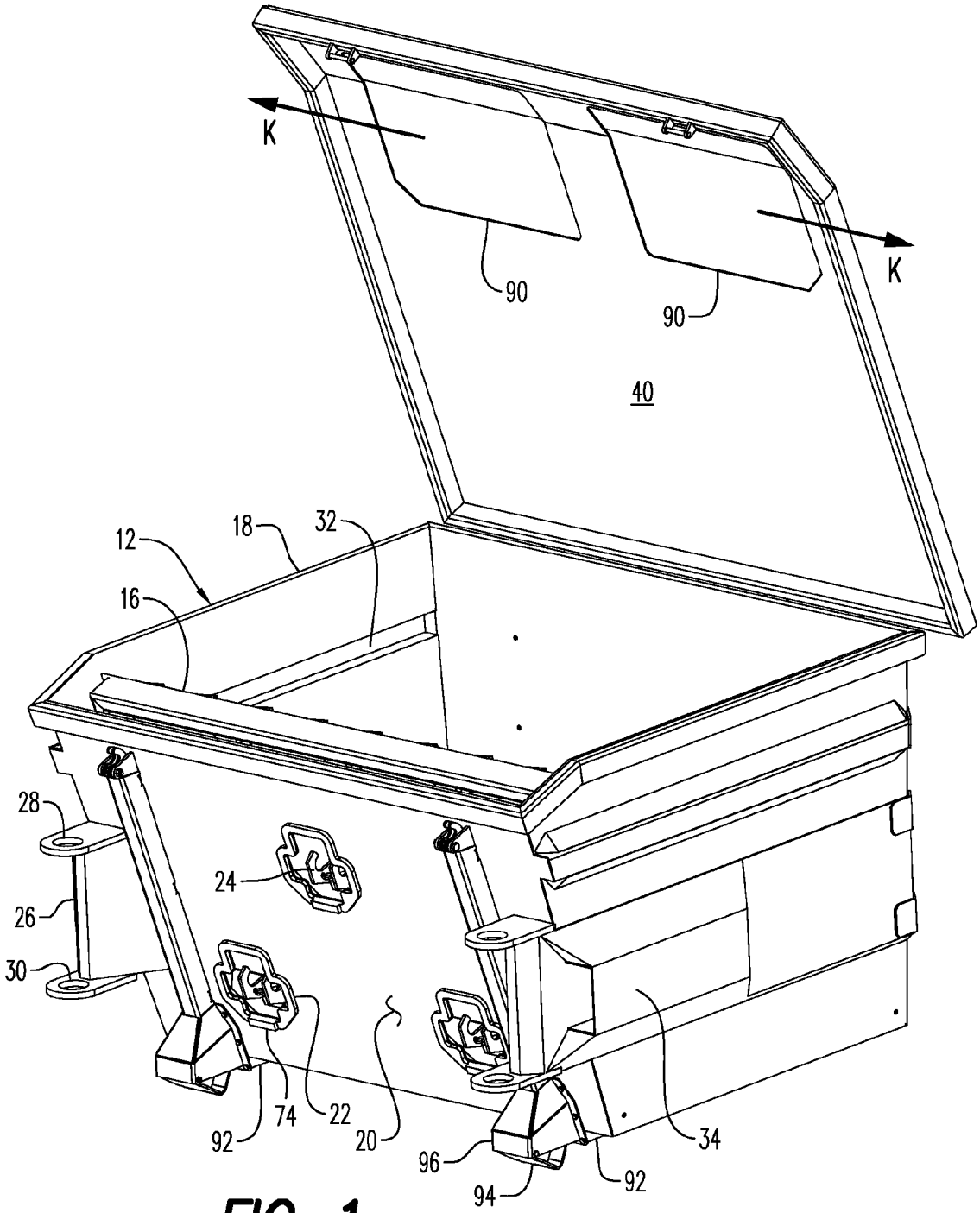
FIG. 1 is a perspective view showing the trash receptacle assembly in a lid-open position.

Exemplary embodiments are illustrated in reference figures of the drawings. It is intended that the embodiments and figures disclosed herein are to be considered to illustrative rather than limiting.

DETAILED DESCRIPTION OF THE INVENTION

Referring now to the drawings, and particularly to FIGS. 1 to 5, the preferred embodiment of the trash receptacle assembly is there shown generally at numeral 12. The trash receptacle assembly 12 includes the receptacle 18 having upright side walls, a back panel and a front panel 20, along with a closed bottom thereof. The configuration of the front panel 20 is sloped generally outwardly or forwardly and includes three spaced actuator openings 22, the purpose of which will be described herebelow. The trash receptacle assembly 12 further includes a lid 40 pivotally attached to the upright back panel about a lid hinge bar 82 for convenient pivotal opening as the assembly 12 is lifted by a forklift truck facilitated by engagement with lift sockets 34 attached to the outer surfaces of the side panels of the receptacle 12. Thus, with respect to the periodic emptying of trash from the receptacle assembly 12, a forklift truck (not a part of this invention) simply engages its forks horizontally into the lift sockets 34 and lifts the entire assembly 12 upwardly, then tipping the assembly 12 through an overhead angle of approximately 90°-270° at which time gravity will automatically open the lid 40 for emptying of trash which has accumulated and been compacted within the receptacle assembly 12.

A separate moveable compaction ram 16 is positioned within the interior volume of the receptacle 18 and, in the at rest position shown in FIG. 1, and later in FIG. 6A, the compaction ram 16 rests against the inner surface of the front panel 20. Movement of this compaction ram 16 is guided by upper and lower slides 36 and 38, respectively, which slide within an upper channel 32 and a lower slide rail 48 which extend fore and aft of the receptacle 18 in spaced parallel fashion as shown. The upper slide 36 is held for rotation and sliding translation within slot 50 formed into the side margin of the compaction ram 16 on glide car shaft 80 which is rigidly connected to a glide car 86. By positioning the compaction ram 16 in the forwardly tipped at rest position against the front wall 20, trash may periodically be manually deposited within the receptacle 18 through doors 90 which slidably open in the direction of arrows K in FIG. 1.

Attached to one face of the compaction ram 16 are three spaced ram connectors 24, each of which define an upwardly facing U-shaped hook. Each of these ram connectors 24 is oriented to align with the corresponding actuator opening 22 as best seen in FIG. 1. The compaction ram 16, as best seen in FIGS. 3 to 5 and 7, includes an inwardly facing surface which carries of a plurality of spaced apart elongated V-shaped concentrator wedges 46 which extend along substantially the entire inner face of the compaction ram 16. These elongated wedges 46 serve to enhance the trash compactability aspect of the present invention as will be described more fully herebelow.

As will be more fully described below with reference to FIGS. 6A-E, the trash compaction process of this disclosure generates considerable internal forces. Therefore, the lid 40 must be securely restrained in the closed position during each compaction cycle.

Figure 2:
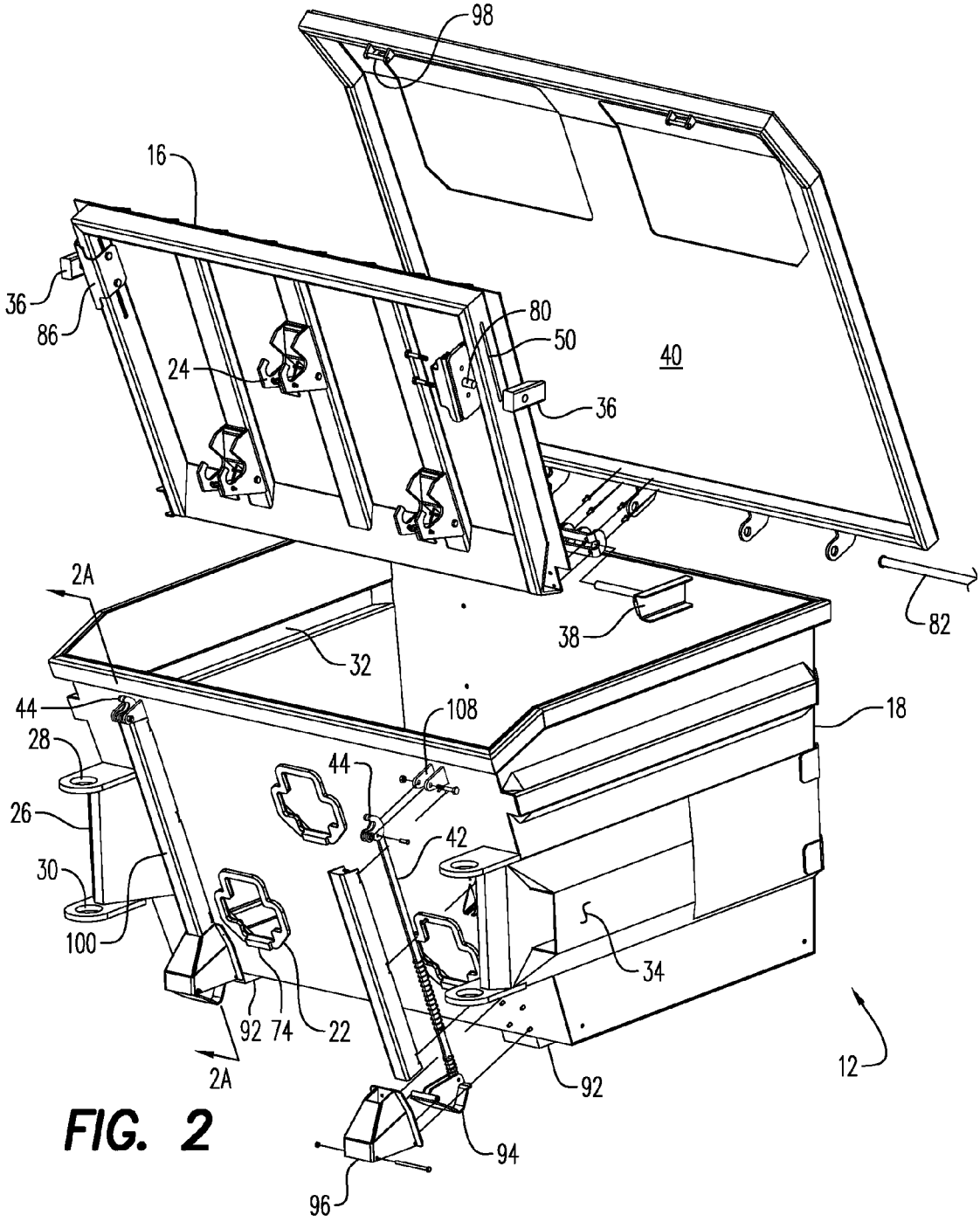
FIG. 2 is an exploded view of FIG. 1.
Figure 2A:
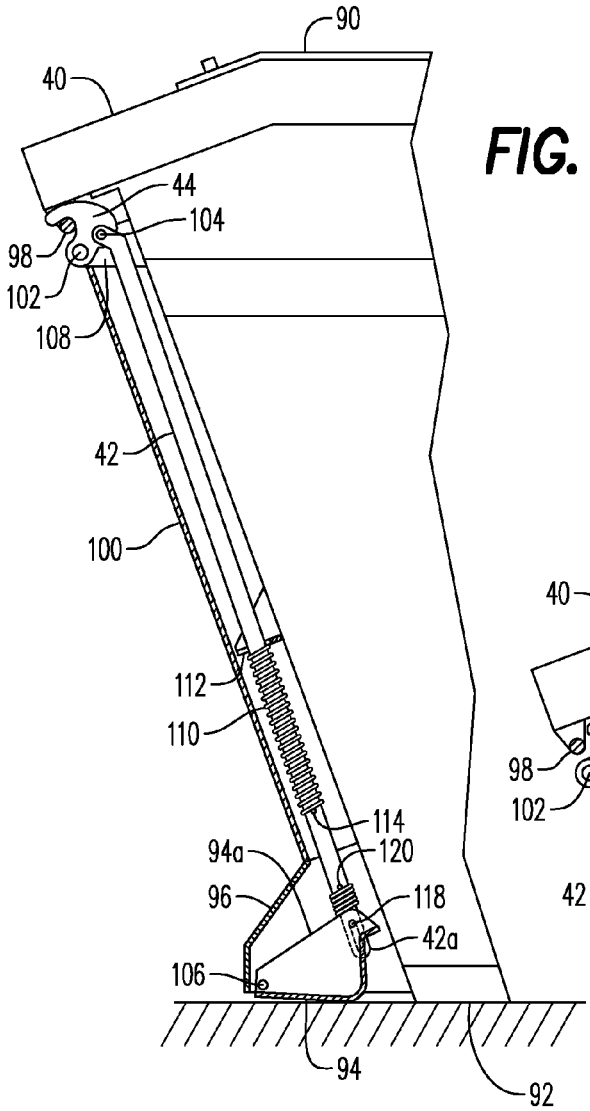
Figure 2B:
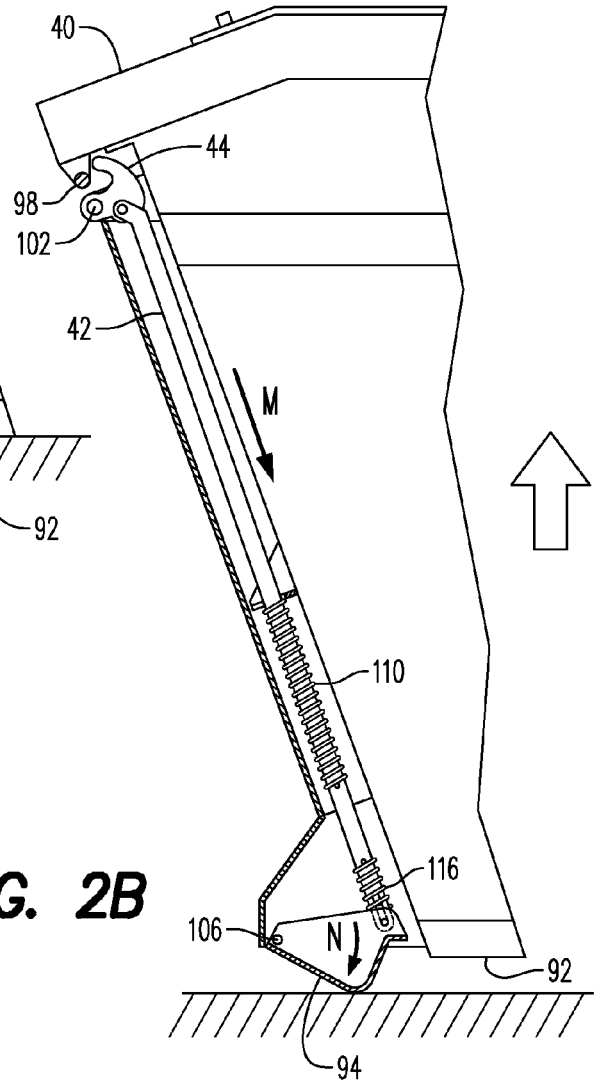
Figure 3:
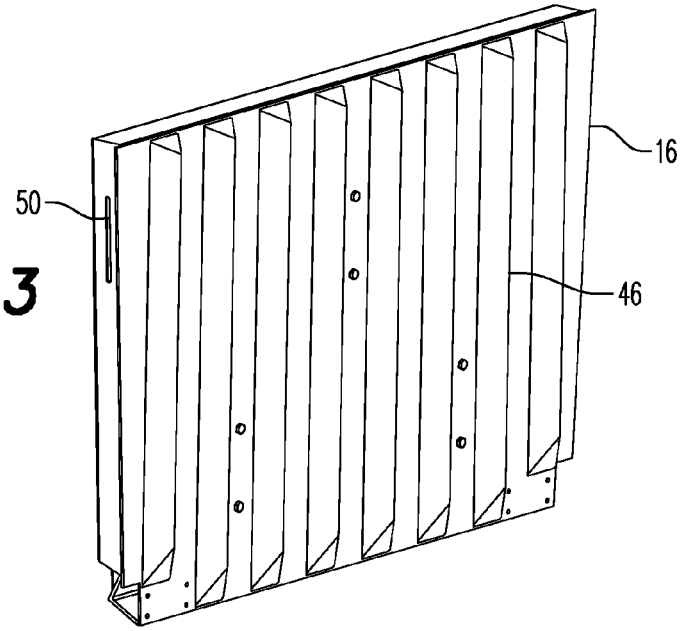
FIG. 3 is a perspective view of the movable compaction ram.
Figure 4:
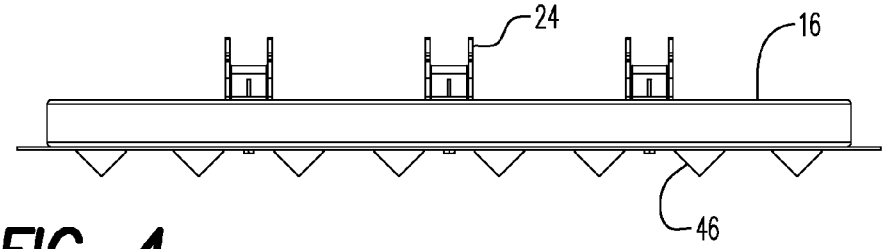
FIG. 4 is a top plan view of FIG. 3.
Figure 5:
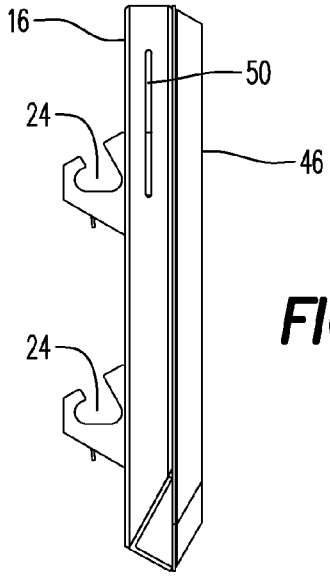
FIG. 5 is an end elevation view of FIG. 3.

When the lid 40 is in the closed position as best seen in FIGS. 2A and 2B, the receptacle assembly 12 rests upon elongated fore and aft extending floor supports 92. A foot 94 is connected adjacent each forwardly lower corner of the receptacle 18 about a foot pivot shaft 106 passing through an outer margin of a foot cover 96 attached to the front panel 20. An elongated lid hook link 42 is slidably connected about link lower pin 118 to each corresponding foot 94 and extends within an elongated protective cover 100 which is also attached to the outer surface of the front panel 20. The upper end of each lid hook link 42 is pin connected by an upper pin connection 104 to a lid latch 44, the lid latch being pivotally connected about latch pivot 102 to a latch support bracket 108 also connected to the outer surface of the front panel 20.

Two coil springs 110 and 116 are positioned over the lid hook link 42. The main spring 110 is held in compression between spring stop bracket 112 attached to the front panel 20 and a spring stop pin 114 rigidly connected transversely through the hook link 42. Spring 116 at its lower end bears against an edge of foot 94 while the upper end thereof is restrained by spring pin 120.

The lid 40 includes two spaced apart lid hooks 90 which align themselves into a notch formed into the lid latch 44 as best seen in FIG. 2A. Thus, when the receptacle assembly 12 is resting atop the floor or ground, each foot 94 is pivoted upwardly about each foot pivot shaft 106 into coplanar relationship with bottom surface of each floor support 92. In this orientation, each hook link 42 is in its upper position and each lid latch 44 engages with the corresponding lid hook 98 to hold the lid 40 in a closed position.

As seen in FIG. 2B, when the trash receptacle assembly 12 is lifted by a forklift truck about lift sockets 34 as previously described, in order to empty the trash contents in the receptacle 18, each foot 94 is rotated downwardly in the direction of arrow N, which moves each of the lid hook link 42 in the direction of arrow M, causing the lid latch 44 to also pivotally rotate about latch pivot 102 disengaging the lid latch 44 from each lid hook 98. Thereafter, the forklift truck will continue to lift and pivot the receptacle assembly 12 into an overhead orientation to dump the trash contents into the bed of the trash pickup truck. Still referring to FIGS. 1 and 2, spaced apart lifting brackets 26, also connected to the outer surface of the front panel 20, include spaced upper and lower engagement holes 28 and 30, the purpose of which will be described herebelow. Note an additional benefit of this self- or automatic lid lock feature. Only trash which will fit through the doors may be deposited into the trash receptacle so long as the lid is locked closed.

Operational Sequence

Figure 8:
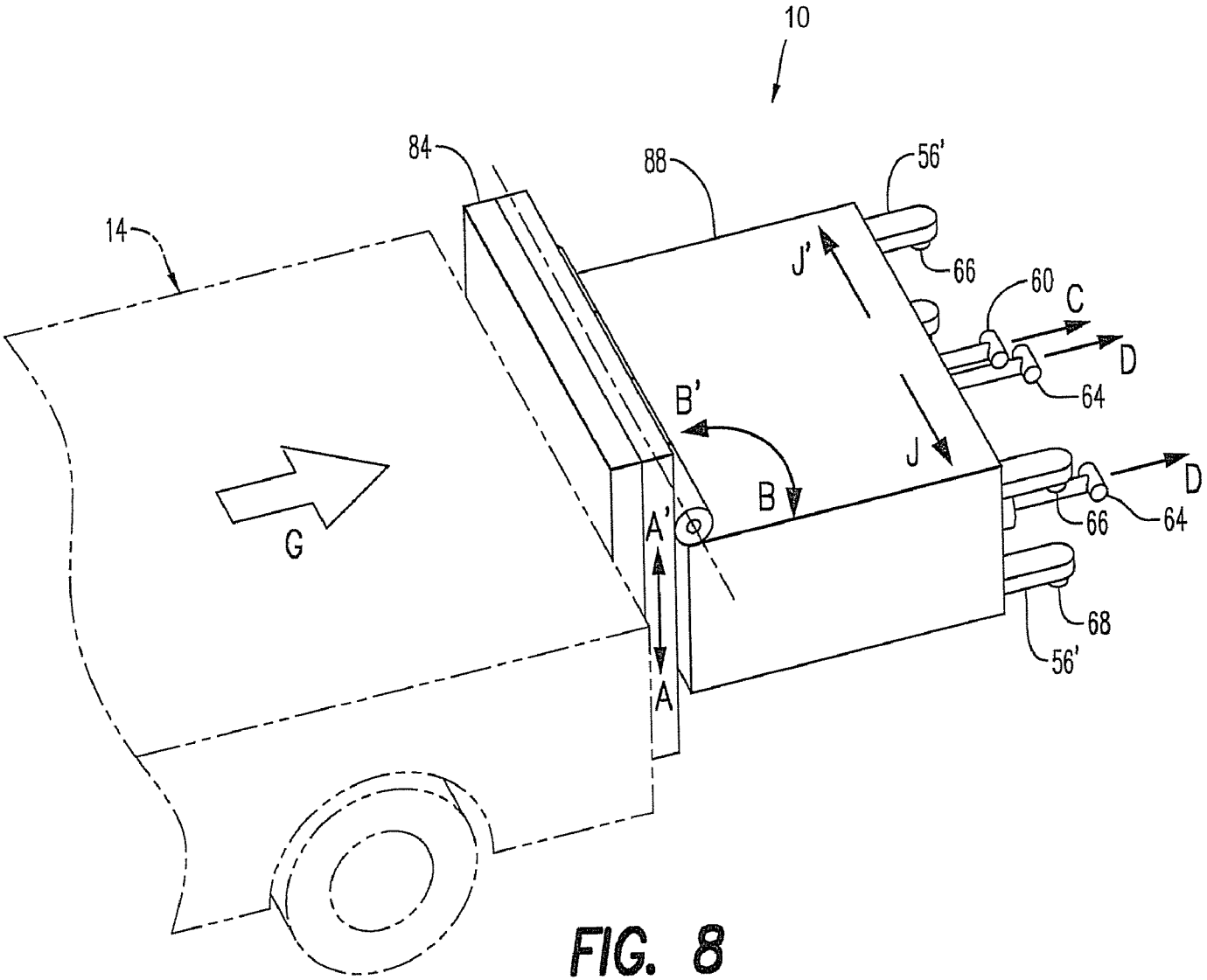
FIG. 8 is a rearward perspective view of one end of the drivable satellite vehicle and the power unit attached thereto.
Figure 9:
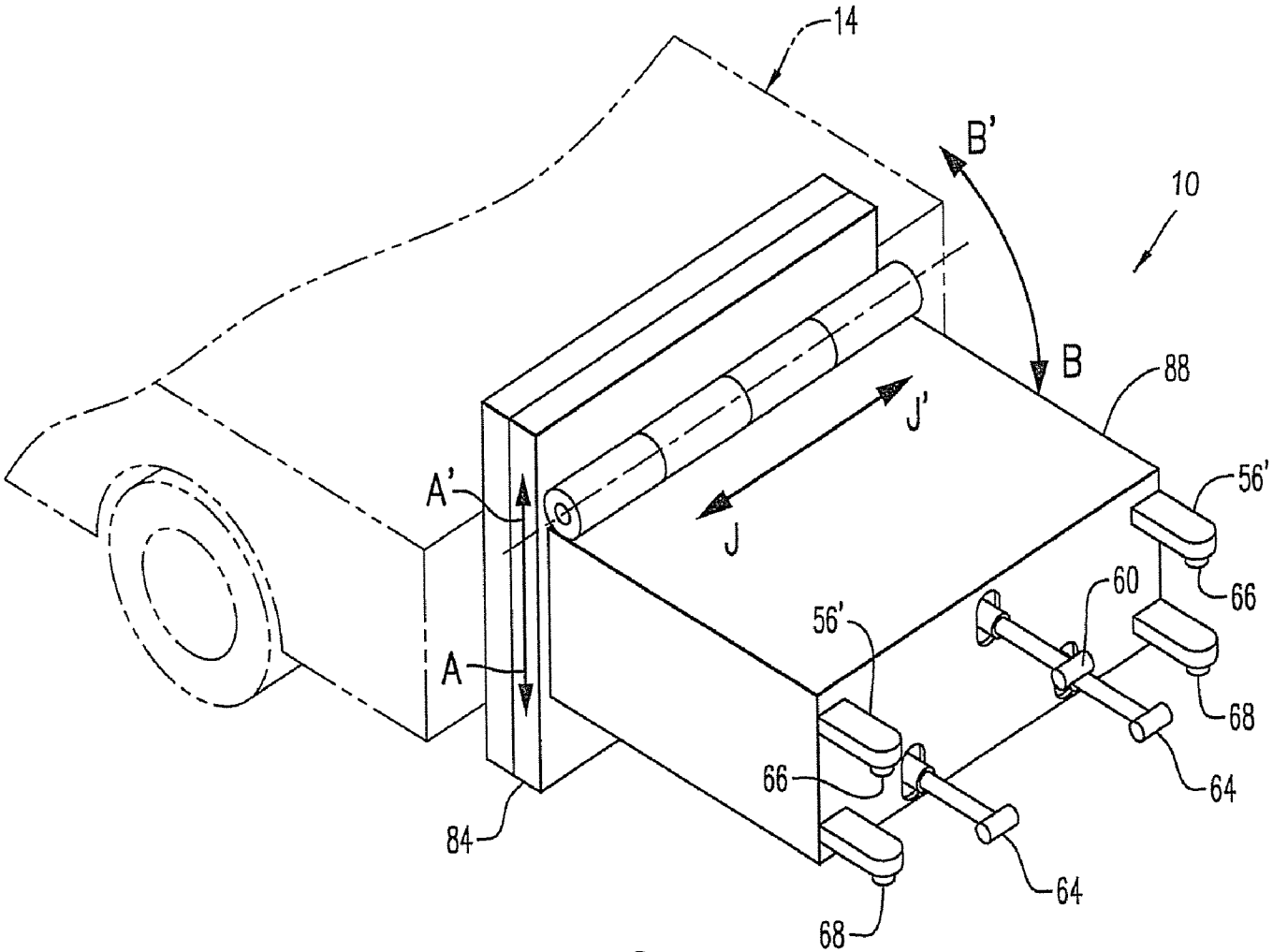
FIG. 9 is a forward perspective view similar to FIG. 8.

Referring now to FIGS. 6A to 6E, the complete sequence of initial engagement between a power unit shown generally at numeral 10 in FIGS. 8 and 9, which is attached to a satellite vehicle 14 (shown in phantom) and the trash receptacle assembly 12, is there depicted. The satellite vehicle 14, which is separately drivable to the location of each of the trash receptacle assemblies 12, includes the power unit 10 supported at one end of the satellite vehicle 14. The power unit 10 includes a vertical mounting plate 84 movable in the direction of arrows A/A'. A housing assembly 88 connected to the vehicle mounting plate 84 is pivotally movable in the direction of arrows B/B' about an axis of rotation shown and is also movable laterally in the direction of arrows J/J'. The housing assembly 88 includes two spaced apart sets of locking pin supports 56 or 56', each of which includes downwardly oriented upper and lower locking pins 66 and 68, respectively. Extending from the face of the housing assembly 88 are three separate upper and lower cylinders 52 and 54 and associated actuators 58 and 62, respectively. These actuators 58 and 62 may be pneumatically or hydraulically powered to effect linear extension and contraction thereof in the direction of arrows C and D, respectively. Transverse upper and lower connecting bars 60 and 64, respectively, are attached to the distal ends each of the actuators 58 and 62, respectively.

Operational Sequence

Figure 6A:
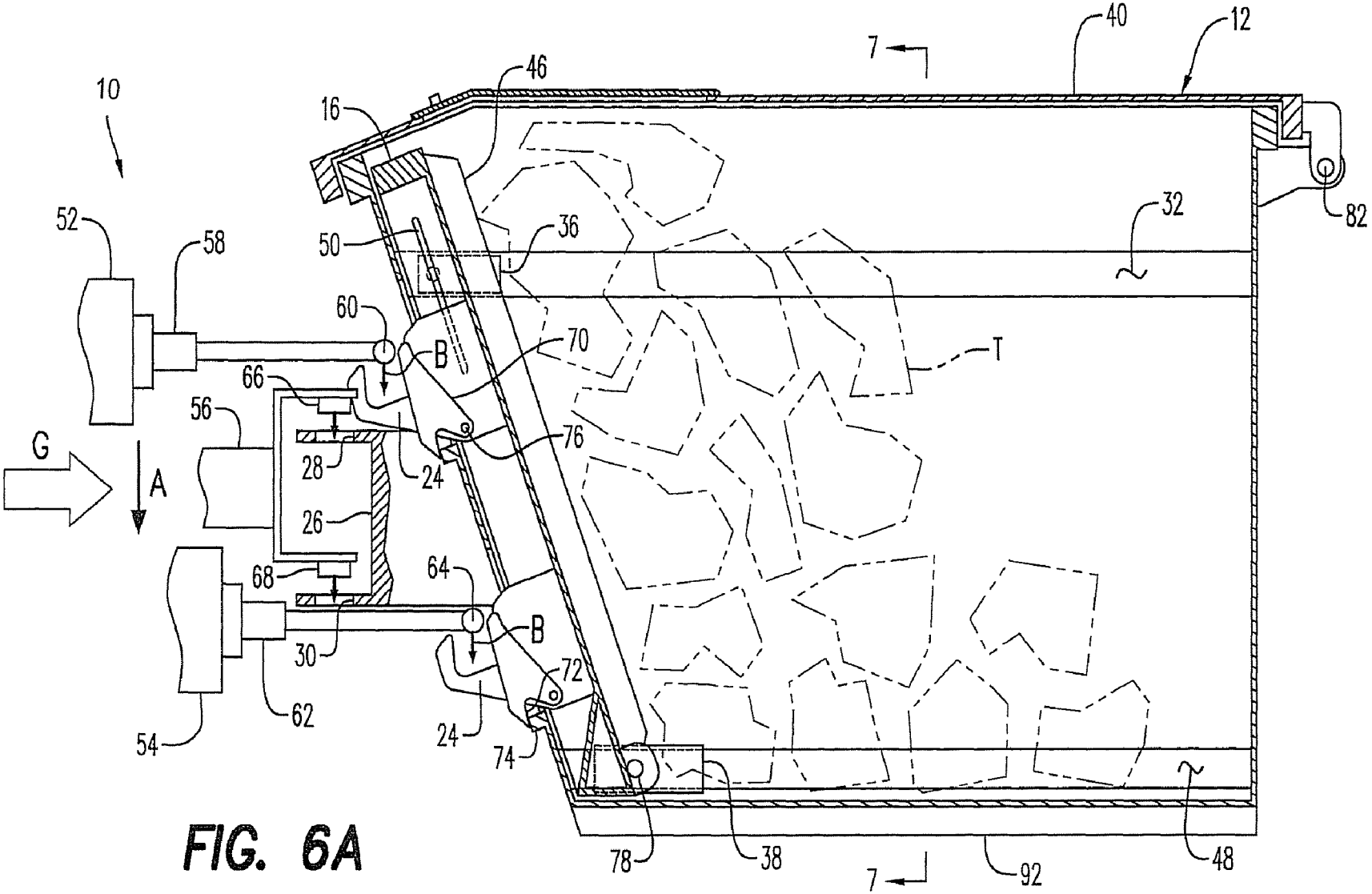
FIGS. 6 (A and B) are side elevation section view of FIG. 1 showing the sequence of temporary engagement between the compaction ram and the power unit attached or attachable to the satellite vehicle.
Figure 6B:
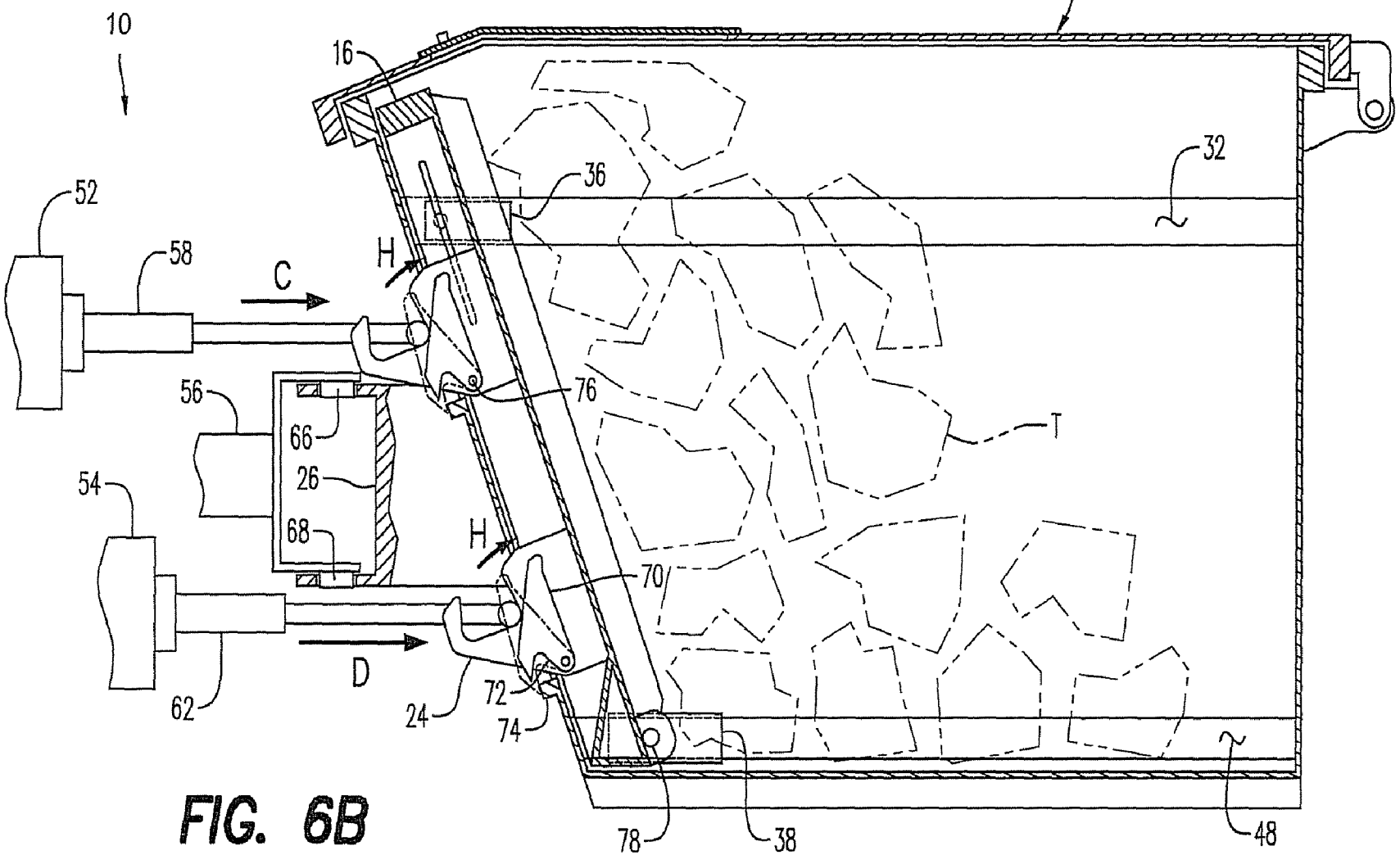
Figure 6C:
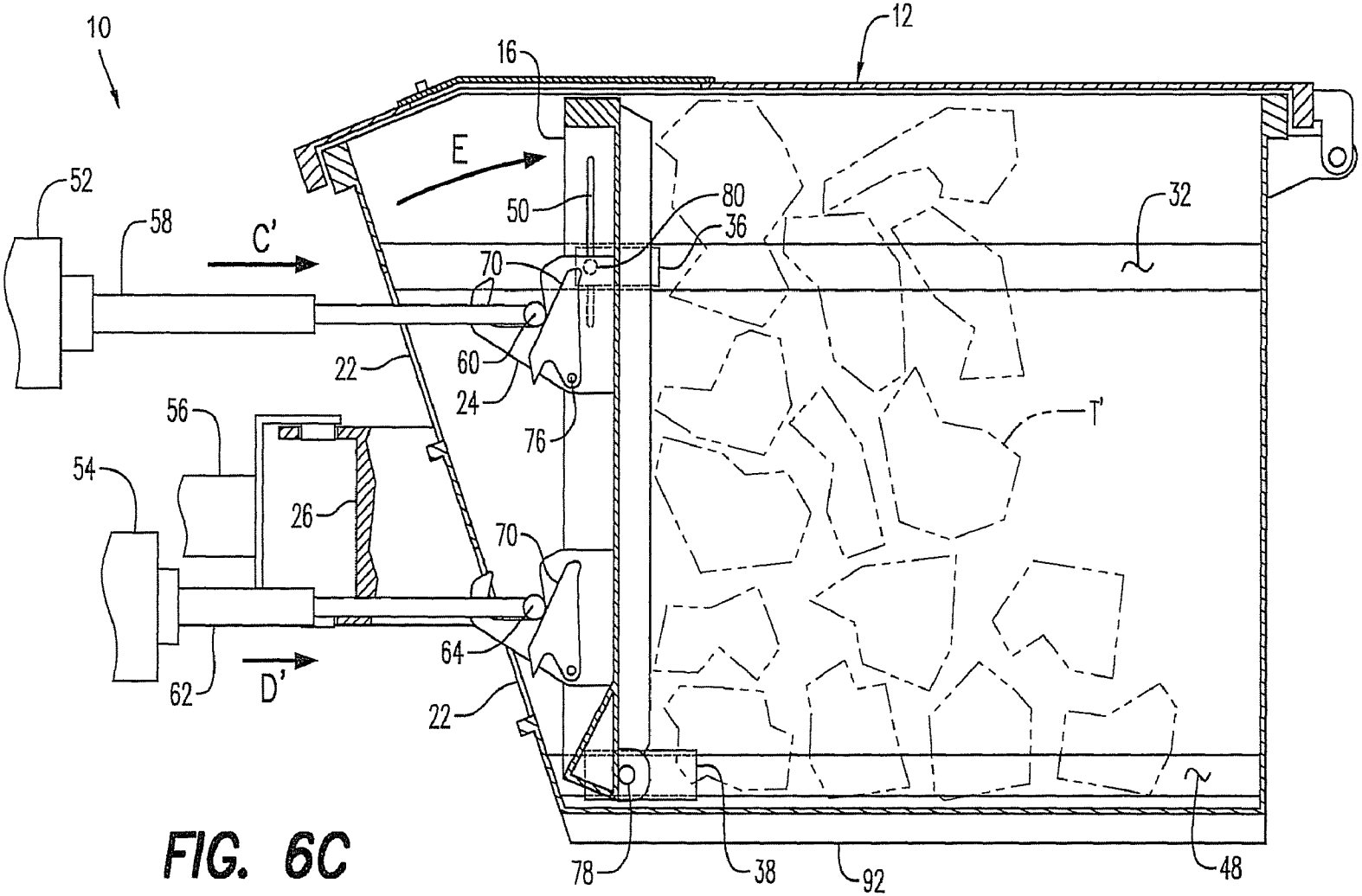

Referring now to FIGS. 6A to 6E, the complete sequence of engagement and movement between the vehicle/power unit 14/10 is thereshown. As the satellite vehicle 14 is moved toward the front panel 20 of the trash receptacle 12, the connector bars 60 and 64 pass through the corresponding actuator openings 22, having been positioned at a height just above that of the ram connectors 24. The height of the housing assembly 88 is then lowered on the vehicle mounting plate 84 downwardly in the direction of arrow A and/or pivotally moved in the direction of arrow B so as to position the connector bars 60 and 64 into the upwardly oriented jaws of each of the ram connectors 24 as seen in FIG. 6A. Thereafter, actuators 58 and 62 are extended in the direction of arrows C and D, respectively, in FIG. 6B causing the connector bars 60 and 64 to pivotally move each of the ram locks 70 in the direction of arrow H about the lock pin 76 causing the lock notches 72 of each of the ram locks 70 to move in the direction of arrow H. This releases the positional hold of the compactor ram 16 against the inner surface of the front wall 20. Continued extension in the direction of arrows C' and D' of the actuators 58 and 62, respectively, will cause the compaction ram 16 to initially rotate into the upright position in the direction of arrow E shown in FIG. 6C. A slight compaction of the trash T', within the receptacle assembly 12 thus begins.

Figure 6D:
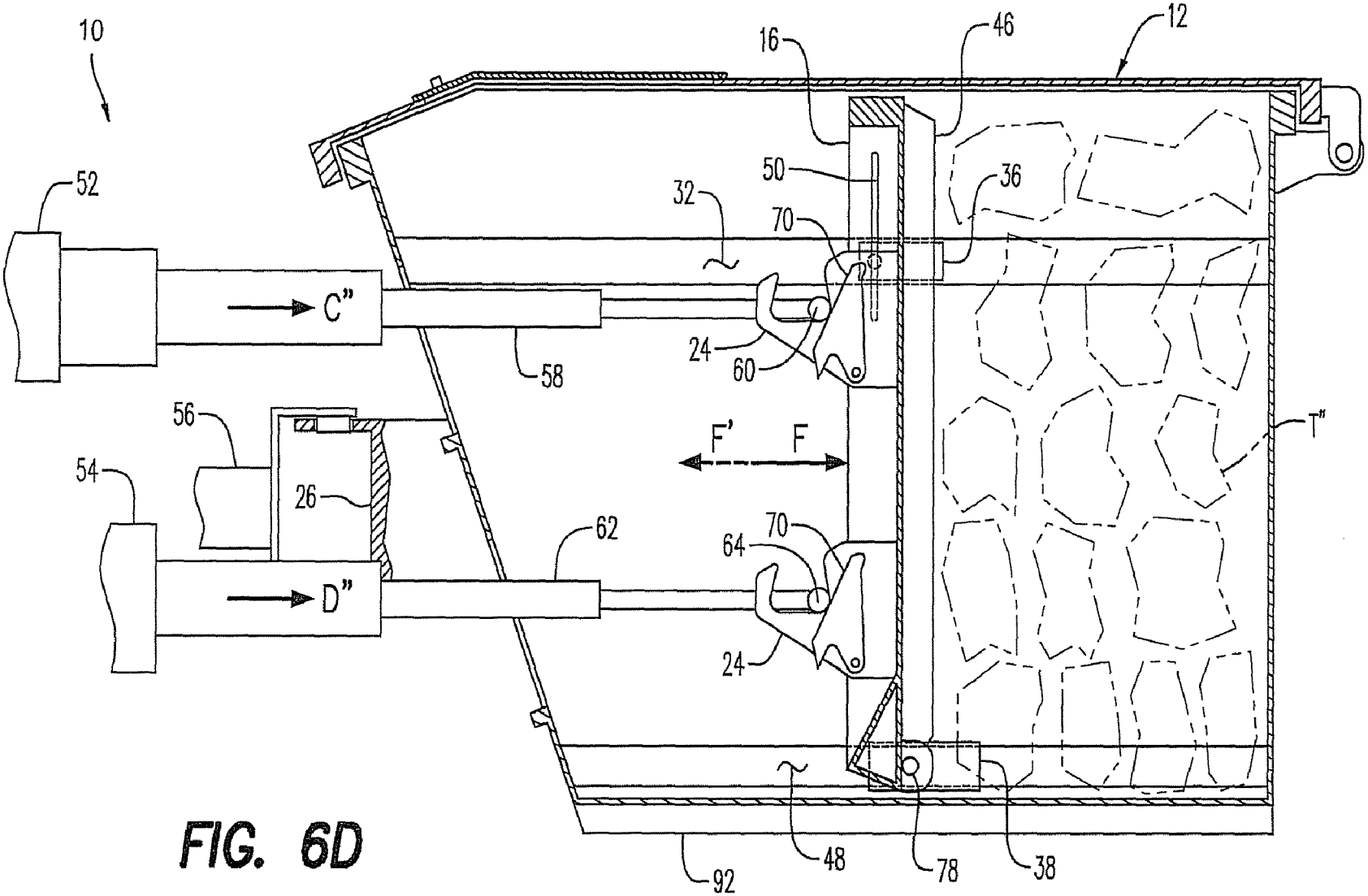
Figure 6E:
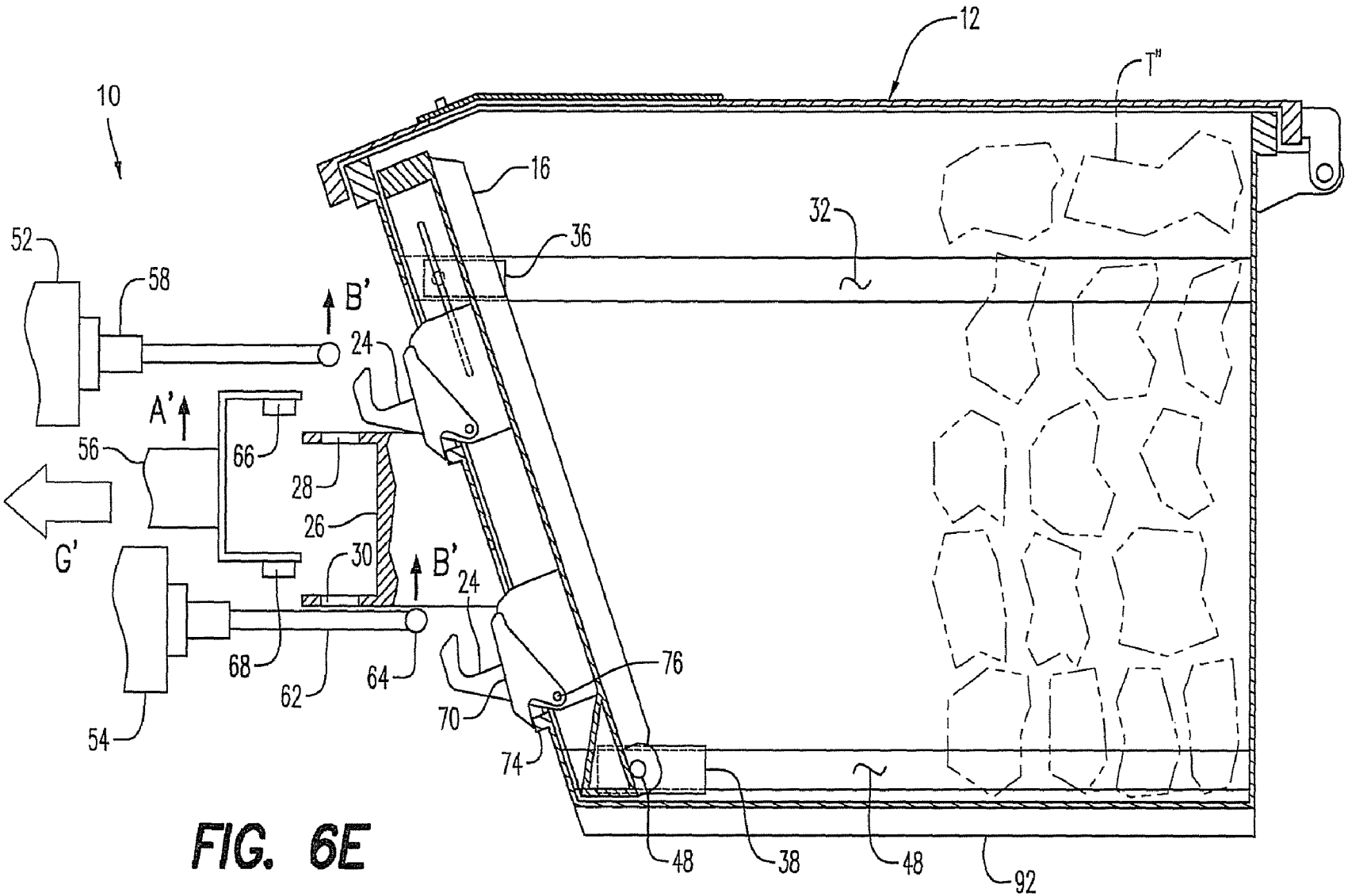
Figure 7:
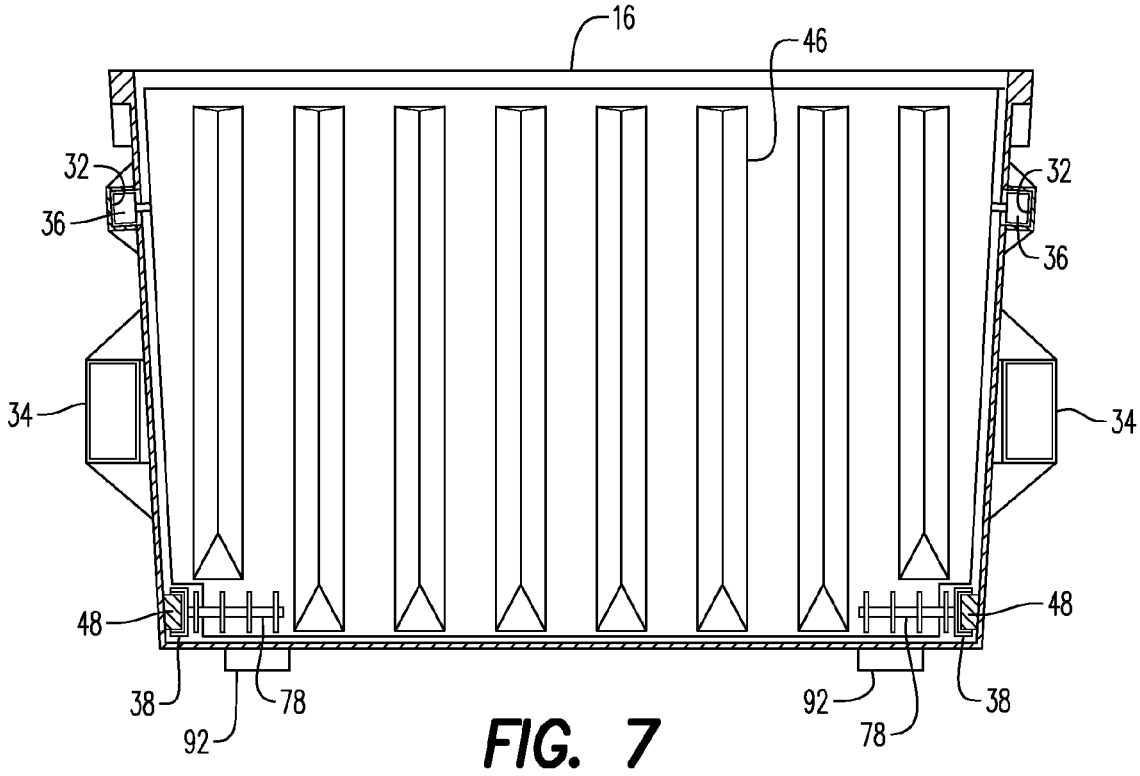
FIG. 7 is a section view in the direction of arrows 7-7 in FIG. 6A.

As seen in FIG. 6D, the actuators 58 and 62 continue to extend in the direction of arrow F at a uniform rate one to another causing the trash to further compact at T" as the compaction ram 16 continues to move aft with respect to the front panel 20 of the trash receptacle assembly 12. When the trash T" is fully compacted by the compaction ram 16, the actuators 58 and 62 then retract causing the compaction ram 16 to move forwardly in the direction of arrow F' back to the at rest position shown in FIG. 6E. The final non-linear movement of the actuators 58 and 62 thus draws the compaction ram 16 back into the orientation against the front panel 20, whereafter, a combination of lifting and/or pivoting of the housing assembly 88 upwardly in the direction of arrow A' and pivotally in the direction of arrow B' effect disengagement of the upper and lower connector bars 60 and 64 from within the upwardly facing jaws of each of the corresponding ram connectors 24. Likewise, the locking pins supports 56 moves upwardly in the direction of arrow A', disengaging the locking pins 66 and 68 from engagement with the engagement holes 28 and 30 of each of the lifting brackets 26.

It is noted that both of the engagements with the trash receptacle assembly 12, i.e., the locking pins support 56 with the lifting bracket 26 and the connector bars 60 and 64 against the ram connectors 24 of the compaction ram 16 are both required to maintain stable positioning of the trash receptacle assembly 12 during compaction. That is the trash receptacle 18 is restrained from movement while the compaction ram 16 is being moved fore and aft within the receptacle 18 to effect compaction of the trash T and then a retraction of the compaction ram 16 back to its at rest position against the inner surface of the front panel 20. Without the opposing forces being generated, the system would be unstable.

Figure 10A:
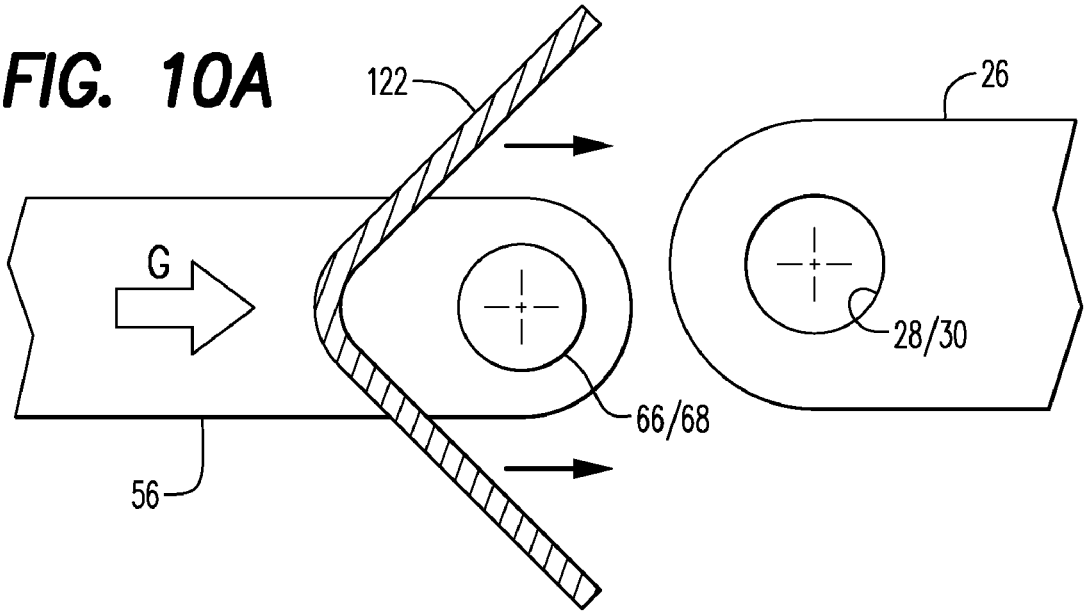
FIGS. 10A and 10B show the sequential approach and alignment between the locking pin support and the lifting bracket assisted by an upright v-shaped alignment plate.
Figure 10B:
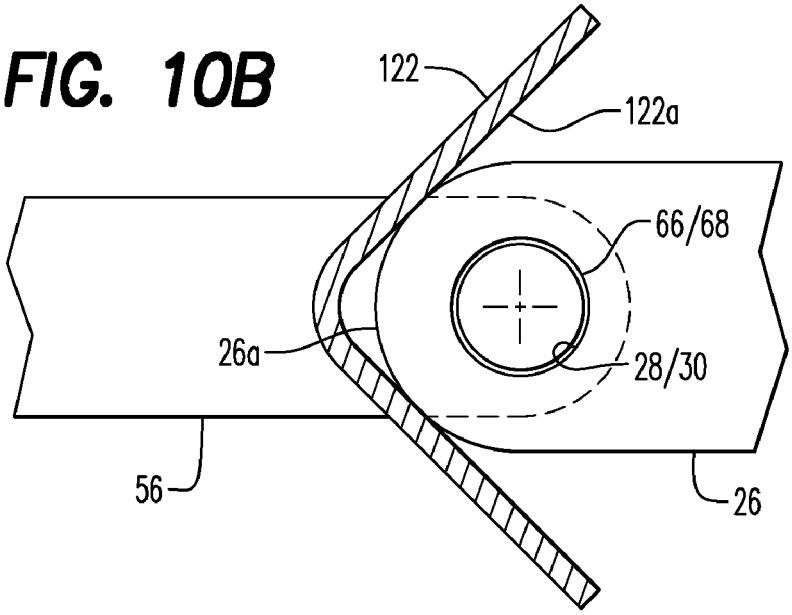

Referring now to FIGS. 10A and 10B, to facilitate quick, accurate alignment between the locking pins 66/68 and the upper and lower engagement holes 28 and 30 of the lifting bracket 26 as the satellite vehicle 14 approaches the trash receptacle assembly 12, an elongated upright V-cross-section alignment plate 22 rigidly connected to each of the locking pin supports 56 is also provided. As the satellite vehicle 14 is driven in the direction of arrow G up to the trash receptacle assembly 12, there may be slight misalignment between the locking pins 66/68 and the engagement holes 28/30. However, as the inner surfaces 122*a* of each of the alignment plates 122 contact the distal arcuate surface 26*a* of each of the lifting brackets 26, two important alignments are achieved, i.e., the lateral, as well as fore and aft, positioning of the locking pins 66 and 68, after which, as shown between FIGS. 6A and 6B, the entire housing assembly 88 is lowered to effect temporary lock engagement between the power unit 10 and the trash receptacle assembly 12. Any lateral misalignment is accommodated by the lateral forced movement of the trash receptacle assembly 12.

Figure 11:
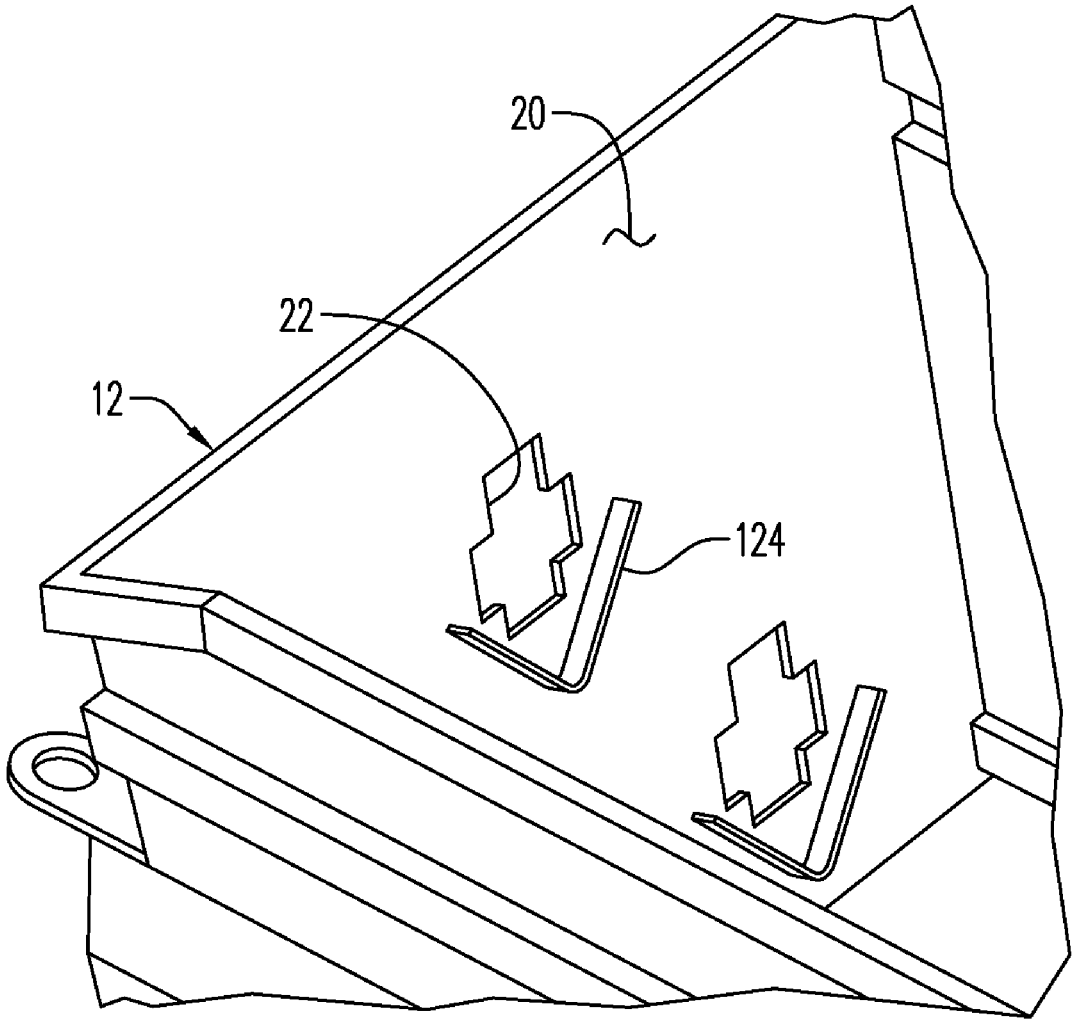
FIG. 11 is an inner perspective view of the front panel and actuator openings depicting the v-shaped splash guards beneath each of the actuator openings.

Referring lastly to FIG. 11, it is common for the trash receptacle 12 to accumulate rainwater and other liquids from the trash within the interior volume when the trash receptacle assembly 12 is lifted as previously described for emptying into a trash refuse pickup truck (not shown), the entire trash receptacle assembly 12 must be both lifted and rotated to empty the contents thereof into the open top of the trash pickup truck. The addition of the actuator openings 22 may thus lead to draining of the liquid prematurely onto the cab or windshield of the trash pickup truck. Splash guards 124 connected to the inner surface of the front panel 20 just below each of the actuator openings 22 serve to divert the liquids within the trash receptacle assembly 12 sufficiently to avoid any such inadvertent liquid drainage.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A system for compacting trash, the system comprising:

a trash receptacle including an outwardly angled upstanding front panel and an opposing back panel, opposing side panels, a closed bottom panel and an opposing lid, the lid including a slidably openable door, and the front panel including a plurality of spaced actuator openings;

upper and lower guide channels carried on each of the opposing side panels;

a compaction ram positioned within the receptacle and extending between the opposing side panels and juxtaposed to the front panel in an open position for movement between the open position in proximity to and generally parallel with an angled inner surface of the front panel for placing trash into the receptacle through the openable door and toward a compaction position to compact trash within the receptacle;

upper and lower ram connectors vertically offset from each other and carried on a forward face of the compaction ram;

a satellite vehicle drivable to the receptacle and including a power unit temporarily engageable with the receptacle and the compaction ram the power unit moving the compaction ram to the compaction position to compact the trash within the receptacle, wherein the power unit comprises upper and lower actuators removably engageable with the upper and lower ram connectors, respectively, and the power unit movable vertically and laterally relative to the satellite vehicle; and drive means operable with the actuators for providing movement thereto.

2. The system as set forth in claim 1, further comprising a lid latch assembly which, when the receptacle is lifted, automatically releases the lid to open for emptying compacted trash therefrom.

3. The system as set forth in claim 1, further comprising fork lift engaging channels connected to each outside surface of the opposing side panels and adapted to receive lifting forks of a trash pickup truck for emptying the contents of the trash receptacle into the truck through the lid when opened.

4. The system as set forth in claim 1, further comprising locking means operable between the receptacle and the power unit for securing the receptacle to the power unit during operation on the upper and lower actuators when driving the compaction ran between the open and compaction positions.

5. The system as set forth in claim 1, further comprising a ram lock securing the compaction ram against the front panel when the compaction ram is in the open position, the ram lock operable with at least one of the upper and lower ram connectors for releasing the compaction ram from its secured position against the front panel during operation of the ram connector for moving the compaction ram.

6. A system for compacting trash, the system comprising:

a trash receptacle defined by an outwardly angled upstanding front panel, an opposing back panel, and opposing side panels connected therebetween, a closed bottom panel and an opposing lid, and the front panel including a plurality of spaced actuator openings;

upper and lower guide channels carried on each of the opposing side panels;

a compaction ram positioned within the receptacle and extending between the opposing side panels and juxtaposed to an angled inside surface of the front panel when in an open position, the compaction ram moveable between the open position in proximity to and generally parallel with the angled inside surface of the front panel to a compaction position for compacting trash placed within the receptacle;

upper and lower ram connectors carried on a forward face of the compaction ram;

a satellite vehicle drivable to and operable with the receptacle, the satellite vehicle including a power unit dimensioned for operation with the compaction ram, the power unit moving the compaction ram providing a compaction force for driving the compaction ram to the compaction position, wherein the power unit comprises upper and lower actuators removably engageable with the upper and lower ram connectors, respectively, and the power unit movable vertically and laterally relative to the satellite vehicle;

drive means operable with the actuators for providing movement thereto; and locking means operable between the receptacle and the power unit for securing the receptacle to the power unit during operation on the upper and lower actuators when driving the compaction ram between the open and compaction positions.

7. The system as set forth in claim 6, further comprising a lid latch assembly operable with the lid for automatically releasing the lid during an emptying of trash from the receptacle.

8. The system as set forth in claim 6, further comprising fork lift engaging channels connected to each outside surface of the opposing side panels and adapted to receive lifting forks of a trash pickup truck.

9. The system as set forth in claim 6, further comprising a ram lock securing the compaction ram against the front panel when the compaction ram is in the open position, the ram lock operable with at least one of the upper and lower ram connectors for releasing the compaction ram from its secured position against the front panel during operation of the ram connector for moving the compaction ram.

* * * * *